US009663265B1

(12) United States Patent
Olds

(10) Patent No.: US 9,663,265 B1
(45) Date of Patent: May 30, 2017

(54) CONTAINER BOTTOM LOCKING FEATURES AND RELATED METHODS

(71) Applicant: INTEPLAST GROUP CORPORATION, Livingston, NJ (US)

(72) Inventor: David Olds, Vanceburg, KY (US)

(73) Assignee: INTERPLAST GROUP CORPORATION, Livingston, NJ (US)

( * ) Notice: Subject to any disclaimer, the term of this patent is extended or adjusted under 35 U.S.C. 154(b) by 0 days.

(21) Appl. No.: 15/151,390

(22) Filed: May 10, 2016

(51) Int. Cl.
*B65D 5/10* (2006.01)
*B31B 3/26* (2006.01)
*B31B 3/60* (2006.01)

(52) U.S. Cl.
CPC ..... *B65D 5/106* (2013.01); *B31B 3/26* (2013.01); *B31B 3/60* (2013.01); *B31B 2203/066* (2013.01)

(58) Field of Classification Search
CPC ..... B65D 5/103; B65D 5/106; B31B 3/60; B31B 3/26; B31B 2203/066
USPC ..... 229/155–157
See application file for complete search history.

(56) References Cited

U.S. PATENT DOCUMENTS 1,470,141 A * 10/1923 Bryson ..... B65D 5/0263 206/807
2,337,039 A 5/1941 Gardner, Jr.
2,349,707 A * 5/1944 D Esposito ..... B65D 5/106 229/155
2,617,581 A 11/1952 Smith
3,028,952 A * 4/1962 Milio ..... A22C 13/023 206/446
3,092,299 A 6/1963 Hasselhoff
3,104,795 A * 9/1963 Adams ..... B65D 5/106 229/155
3,140,813 A * 7/1964 Hall ..... B65D 5/46088 229/117.22
3,201,026 A * 8/1965 Travis ..... B65D 5/106 229/132
3,337,115 A 8/1967 Jones
3,462,066 A * 8/1969 Farquhar ..... B65D 5/106 206/807
3,642,192 A * 2/1972 Wilcox, Jr. ..... B65D 5/061 229/117.05
3,801,001 A * 4/1974 Taylor ..... B65D 5/103 229/139
3,869,079 A 3/1975 Oglesbee
4,013,213 A 3/1977 Giebel
4,477,017 A * 10/1984 Webinger ..... B65D 5/106 229/185
6,364,200 B1 4/2002 Moss et al.
6,688,514 B2 2/2004 Evans et al.
(Continued)

*Primary Examiner* — Christopher Demeree
(74) *Attorney, Agent, or Firm* — Phillips Ryther & Winchester; Matthew D. Thayne

(57) ABSTRACT

Containers, and sheets for forming containers, having bottom locking features, and related methods. In some embodiments, two opposing bottom panels of a sheet may be configured to define at least a portion of a bottom wall of a container. One such bottom panel may comprise a locking tab and the other such bottom panel may comprise a locking aperture configured to receive the locking tab. In a finished configuration, the locking tab may extend at least substantially parallel to the bottom panels within the locking aperture, and the locking tab and locking aperture may be spaced apart from the side walls of the container in the finished configuration.

20 Claims, 7 Drawing Sheets

(56) References Cited

U.S. PATENT DOCUMENTS

| | | | | |
|---|---|---|---|---|
| 8,925,795 | B2 * | 1/2015 | Little | B65D 5/0227 229/155 |
| 2006/0226209 | A1 | 10/2006 | Peniche et al. | |
| 2007/0170234 | A1 | 7/2007 | Cargile, Jr. | |
| 2015/0251797 | A1 | 9/2015 | Carman | |

* cited by examiner

CONTAINER BOTTOM LOCKING FEATURES AND RELATED METHODS

SUMMARY

Embodiments of sheets configured to be assembled into foldable containers, such as foldable, plastic, produce containers, are disclosed herein, along with implementations of related methods. Finished containers are also described herein. In some embodiments, such sheets/containers may comprise a plastic, such as a corrugated plastic, and may be configured to be sufficiently sturdy to withstand multiple uses. In preferred embodiments and implementations, the sheets may comprise one or more locking features, which feature(s) may be incorporated into one or more panels of the sheet configured to define a bottom wall in the container.

Such locking features may be configured to substantially improve the strength of the bottom wall otherwise provided. For example, many known containers provide a "snap lock" or "1-2-3 bottom." By the addition of one or more of the elements/features described herein, such as a specifically placed and/or configured bottom locking element, the amount of force on the bottom wall required to cause the container to fail, such as by causing one or more of the panels defining the bottom wall to become uncoupled, may be increased substantially. For example, in some embodiments, this locking element/feature, in some embodiments in combination with other features described herein, may result in an increase of strength such that at least twice as much force may be applied to a central location on the bottom wall of the inside of the container before failure. In some such embodiments, these improvements may result in an increase of strength such that at least three times as much force may be applied to a central location on the bottom wall of the inside of the container before failure.

In a more specific example of an embodiment of a sheet for folding into a container, the sheet may comprise a first bottom panel configured to define at least a portion of a bottom wall of a container, wherein the container in a finished configuration comprises a first side, a second side, a third side opposite from the first side, and a fourth side opposite from the second side. The first bottom panel may be configured to extend from the first side towards the third side in the finished configuration, and may comprise a locking tab. A second bottom panel may be configured to define at least a portion of the bottom wall of the container, wherein the second bottom panel is configured to extend from the second side towards the fourth side in the finished configuration. A third bottom panel may be configured to define at least a portion of the bottom wall of the container, wherein the third bottom panel is configured to extend from the third side towards the first side in the finished configuration. The third bottom panel may comprise a locking aperture configured to receive the locking tab and, in the finished configuration, the locking tab may extend at least substantially parallel to the third bottom panel within the locking aperture. The locking tab and/or the locking aperture may be configured to increase an amount of force on the bottom wall required to unfold panels defining the bottom wall. The sheet may further comprise a fourth bottom panel configured to define at least a portion of the bottom wall of the container, wherein the fourth bottom panel is configured to extend from the fourth side towards the second side in the finished configuration.

In some embodiments, the third bottom panel may comprise a first edge foldably coupled to a side panel at the third side; and a second edge opposite from the first edge, wherein the locking aperture is spaced apart from the first edge, and wherein the locking aperture is spaced apart from the second edge. In some such embodiments, the locking tab may be configured to be engaged with the locking aperture at a central location, or an at least substantially central location, on the bottom wall relative to first side, second side, third side, and fourth side of the container.

In some embodiments, the locking aperture may comprise a slot positioned and configured to allow a user to insert a finger therethrough when the third bottom panel is positioned parallel to the fourth bottom panel with the locking tab positioned adjacent to the locking aperture. In some such embodiments, the slot may be configured to allow only a single finger to be inserted therethrough when the third bottom panel is positioned parallel to the fourth bottom panel with the locking tab positioned adjacent to the locking aperture.

The locking tab may comprise at least one flap configured to be bent during assembly of the sheet into a container to allow the locking tab to extend through the locking aperture. In some such embodiments, the locking tab may comprise opposing flaps configured to be bent during assembly of the sheet into a container to allow the locking tab to extend through the locking aperture.

The locking aperture may comprise a length extending between the first side and the third side in the finished configuration, wherein the locking aperture comprises a width extending between the second side and the fourth side in the finished configuration, wherein the locking tab comprises a width extending between the opposing flaps and extending between the second side and the fourth side in the finished configuration, wherein the locking tab comprises a length extending between the first side and the third side in the finished configuration, and wherein the length of the locking tab is less than the length of the locking aperture, and wherein the width of the locking tab is greater than the width of the locking aperture.

In a specific example of a container according to some embodiments, the container may comprise a bottom wall defined by at least a first bottom panel and a second bottom panel. The first bottom panel may comprise a first edge foldably coupled to a first side panel; a second edge opposite from the first edge; and a locking tab positioned adjacent to the second edge. The second bottom panel may comprise a first edge foldably coupled to a second side panel; a second edge opposite from the first edge; and a locking aperture configured to receive the locking tab from the first bottom panel, wherein the locking aperture is spaced apart from the first edge of the second bottom panel, and wherein the locking aperture is spaced apart from the second edge of the second bottom panel.

Some embodiments may further comprise a third bottom panel; and a fourth bottom panel, wherein the bottom wall is further defined by the third bottom panel and the fourth bottom panel.

In some embodiments, the locking aperture may comprise an at least substantially rectangular shape. In some such embodiments, the locking aperture may further comprise a slot extending from one side of the at least substantially rectangular shape, wherein the slot is configured to receive a user's finger during assembly of the container to allow the locking tab to be pulled through the locking aperture.

The locking tab may comprise at least one flap that extends beyond a width of the locking aperture when the locking tab is positioned adjacent to the locking aperture. As mentioned above, in some embodiments, the locking tab may comprise two opposing flaps, each of which extends beyond a width of the locking aperture at opposite ends of the locking aperture when the locking tab is positioned adjacent to the locking aperture.

In a specific example of a method for folding a sheet into a container according to some implementations, the method may comprise folding each of a plurality of side panels with respect to an adjacent side panel to create an open container structure; folding a first bottom panel relative to an adjacent side panel to define at least a portion of a bottom wall of the container, wherein the first bottom panel comprises a locking tab; folding a second bottom panel relative to an adjacent side panel to overlap with the first bottom panel and define at least a portion of the bottom wall of the container, wherein the second bottom panel comprises a locking aperture. In some implementations, the second bottom panel may be folded down and under the first bottom panel. The method may further comprise inserting the locking tab into the locking aperture such that the locking tab engages the locking aperture to lock the first bottom panel in place relative to the second bottom panel, wherein the locking tab is engaged with the locking aperture at a location spaced apart from planes defined by each of the plurality of side panels. This may be done by pulling or pushing the locking tab through the locking aperture.

In some implementations, the method may be performed without use of any adhesives, tapes, or other mechanical elements for securing the bottom wall of the container in a folded configuration.

In some implementations, the locking tab may be configured to be engaged with the locking aperture at an at least substantially central location on the bottom wall of the container relative to the plurality of side panels.

In some implementations, the step of inserting the locking tab into the locking aperture may comprise positioning the locking tab adjacent to the locking aperture; inserting a finger into a slot positioned at one end of the locking aperture; and pulling or pushing the locking tab through the locking aperture. In some such implementations, the step of pulling the locking tab through the locking aperture may comprise bending two opposing flaps formed on opposite ends of the locking tab to allow the locking tab to fit through the locking aperture.

Some implementations may further comprise pushing the second bottom panel under the first bottom panel. For example, in some implementations, after the step of folding the second bottom panel relative to an adjacent side panel to overlap with the first bottom panel and define at least a portion of the bottom wall of the container, the second bottom panel may be repositioned relative to the first bottom panel (such as by pushing the second bottom panel under the first bottom panel) such that the locking tab is repositioned from adjacent to first side of the locking aperture to adjacent to a second side of the locking aperture opposite from the first side.

In some such implementations, the locking aperture may be pulled through the locking aperture from the inside of the container. Alternatively, the locking aperture may be pushed through the locking aperture from the outside of the container.

In some embodiments and/or implementations, the sheet, or at least one or more panels of the sheet, may comprise corrugated flutes, such as fluted, corrugated plastic.

The features, structures, steps, or characteristics disclosed herein in connection with one embodiment may be combined in any suitable manner in one or more alternative embodiments.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Consistent with embodiments disclosed herein, containers, such as, in particular, containers that may be used for transportation and/or storage of relatively heavy items, such as stacks of books, automobile parts, certain kinds of produce, and the like, may be provided, along with foldable sheets for creating such containers. In some embodiments, such containers may comprise corrugated plastic containers. Preferred embodiments may comprise one or more features and/or elements configured to improve the ability of the container to resist failure, particularly in the bottom wall of the container. For example, as described in greater detail below, some embodiments may comprise one or more bottom locking features configured to provide a lock that may enhance or improve the strength of the container along the wall in which the locking feature is present, such as the bottom wall of the container. Various additional features and benefits may be provided in connection with particular embodiments, as discussed in detail below.

Figure 1:
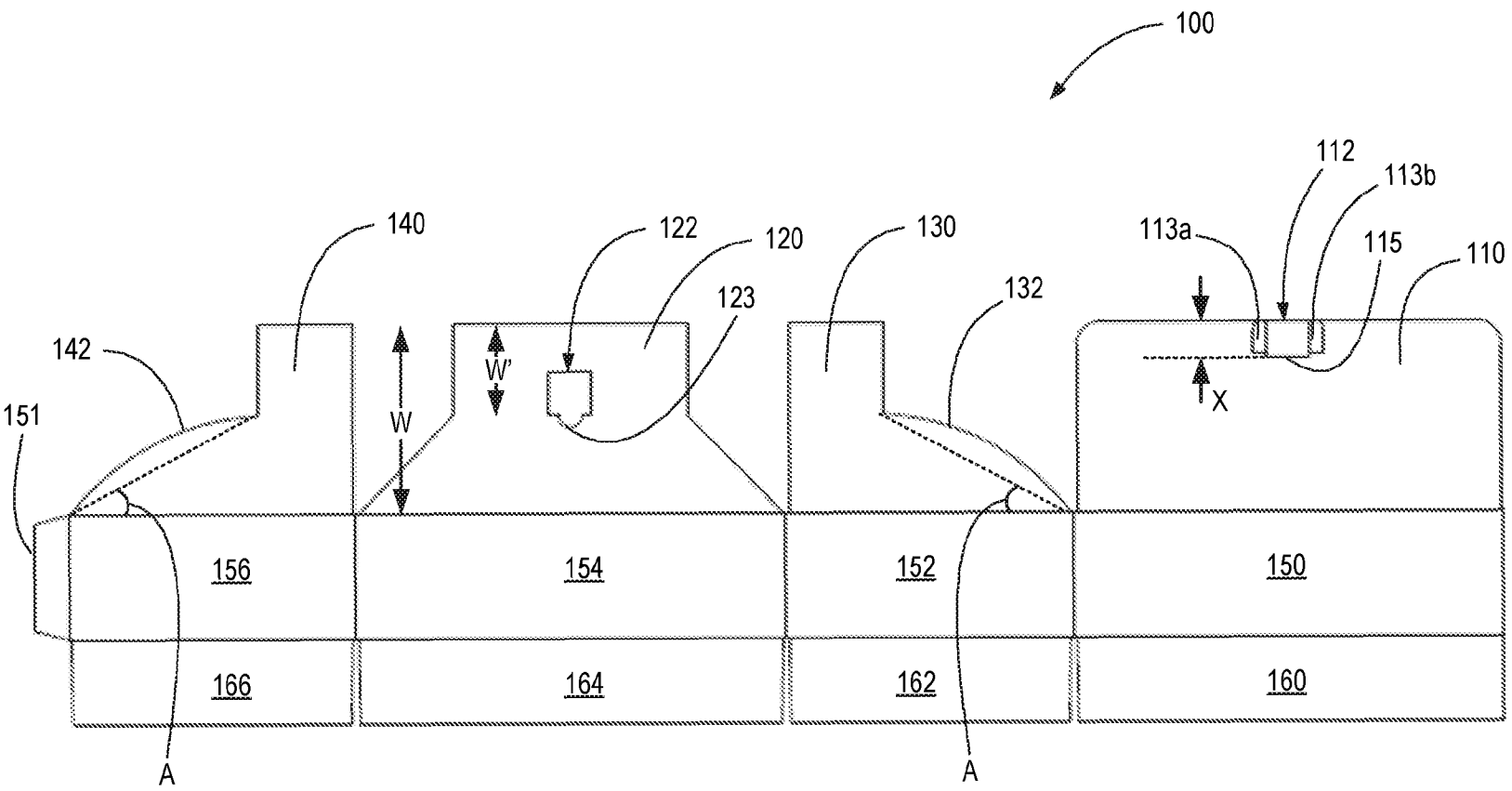
FIG. 1 illustrates a sheet for folding into a three-dimensional container consistent with some embodiments.

FIG. 1 illustrates a sheet 100 consistent with embodiments of the present disclosure. Sheet 100 comprises a substantially planar sheet that may be folded into a three-dimensional container. In some embodiments, sheet 100 may comprise a plastic. In some such embodiments, sheet 100 may comprise a corrugated plastic, such as a plastic made up of corrugated flutes.

Sheet 100 comprises a plurality of panels configured to be folded with respect to one another during a folding/assembly process. Sheet 100 comprises a series of adjacent panels that, when folded/assembled, will collectively form a bottom wall to a container. More particularly, sheet 100 comprises a first panel 110, a second panel 120, a third panel 130, and a fourth panel 140, each of which will, together, define a bottom or lower wall of a container.

A series of adjacent panels 150, 152, 154, and 156 may define respective side walls of the container. Similarly, a series of adjacent panels 160, 162, 164, and 166 may collectively define an upper wall of the container. It should be understood that, in some embodiments, one or more of the panels at one end of the sheet 100 may be coupled with the panels at the opposite end of the sheet 100 such that the sheet 100 may be provided in a configuration that may more easily be assembled. Thus, a flap 151 may be used to couple panel 150 with panel 156 such that panels 150-156 collectively define a closed loop.

Panels 110 and 120 together define elements making up a locking feature. More particularly, panel 110 comprises a locking tab 112. Locking tab 112 may be defined on panel 110 at an end opposite from an end foldably coupled with panel 150. In the depicted embodiment, locking tab 112 comprises opposing flaps 113*a* and 113*b*, one or both of which may be configured to be bent during assembly of the sheet 100 into a container to allow the locking tab 112 to extend through a locking aperture 122 formed on another panel, as discussed in greater detail below.

In some embodiments, locking tab 112 may be formed by simply cutting portions of panel 110 in a suitable manner to define one or more flaps, such as flaps 113*a* and/or 113*b*, and/or folding or weakening a portion of panel 110, such as fold line 115, that may define a border between locking tab 112 and the rest of panel 110. Alternatively, locking tab 112 may be formed from a separate material and coupled to panel 112.

Panel 120 may define a locking aperture 122, which may be configured to receive locking tab 112 to provide a locking interface that may be used to increase the strength of the bottom wall defined by panels 110 and 120. Locking aperture 122 may comprise a slot 123, which may be positioned and configured to allow a user to insert one or more fingers therethrough when bottom panel 120 is positioned parallel to the bottom panel 110 with locking tab 112 positioned adjacent to locking aperture 122, as will be discussed in greater detail below.

Other bottom panels may comprise novel features and/or elements that may further provide strength to the bottom wall of the container. For example, bottom panels 130 and 140 both comprise projections extending away from their respective fold lines with adjacent panels 152 and 156, respectively, which are formed by angled cuts 132 and 142, respectively. In the depicted embodiments, angled cuts 132 and 142 comprise curved cuts that may have a radius of curvature. In some alternative embodiments, however, cuts 132 and 142 may comprise straight cuts, as suggested by the dashed lines in FIG. 1.

In some embodiments, the angle between cuts 132 and/or 142 and their respective adjacent fold lines (labelled as angle "A" in FIG. 1) may be between about 25 degrees and about 40 degrees. In some such embodiments, angle A may be determined by projecting a straight line between the opposite ends of cut 132/142 irrespective of whether these cuts are curved or straight, as suggested by the dashed lines in FIG. 1.

In addition, bottom panel 120 may similarly comprise a projection and, as shown in FIG. 1, in some embodiments, locking aperture 122 may be entirely, or at least substantially entirely, formed within this projection area, which may comprise a rectangular shape. In the depicted embodiment, the rectangular portion of locking aperture 122 is wholly formed within the projection area of bottom panel 120, but slot 123 extends beyond this rectangular projection area. Thus, the side of the rectangular portion of locking aperture 122 that is closest to panel 154 extends along a line that intersects the corners between the angled cuts extends towards panel 154 and the projection area of bottom panel 120. In other words, one of the edges of locking aperture 122 is collinear, or at least substantially collinear, with respect to an edge of the projection area or "tongue" of panel 120.

In some embodiments, the width of the projection area of bottom panel 120 (shown in FIG. 1 as W') relative to the entire width of panel 120 (shown in FIG. 1 as W) may be substantially greater than in previous designs. For example, in some embodiments, W' may be between about 30% and about 70% of W. More preferably, W' may be between about 40% and about 60% of W.

It may also be preferred that, as shown in FIG. 1, locking aperture 122 be formed on panel 120 such that a substantial amount of material is left between a distal end of locking aperture 122 (distal relative to panel 154) and the distal end of panel 120. Thus, in some embodiments, the length of locking aperture 122 in this dimension and/or the positioning of locking aperture 122 may be such that no more than about 60% of the length of the projection area of panel 120 is made up of locking aperture 122. In some embodiments, a solid region comprising at least about the width of the locking tab ("X") plus at least about 0.5 inches, and preferably less than about 65%, of the length of the projection area of panel 120 may be positioned distally of locking aperture 122.

As those of ordinary skill in the art will appreciate, most 1-2-3 bottom containers have a "crown" on panel 110 that is made by cutting out a rectangular region in between opposing ends of the panel, but not extending all the way to such opposing ends, such that two projections are formed at such opposing ends. However, due to the presence of locking tab 112, a crown may be omitted from one or more embodiments disclosed herein, which may allow for providing a "tongue" or "projection area," as referenced above, on the panel configured to overlap with panel 110 that is longer.

Figure 2:
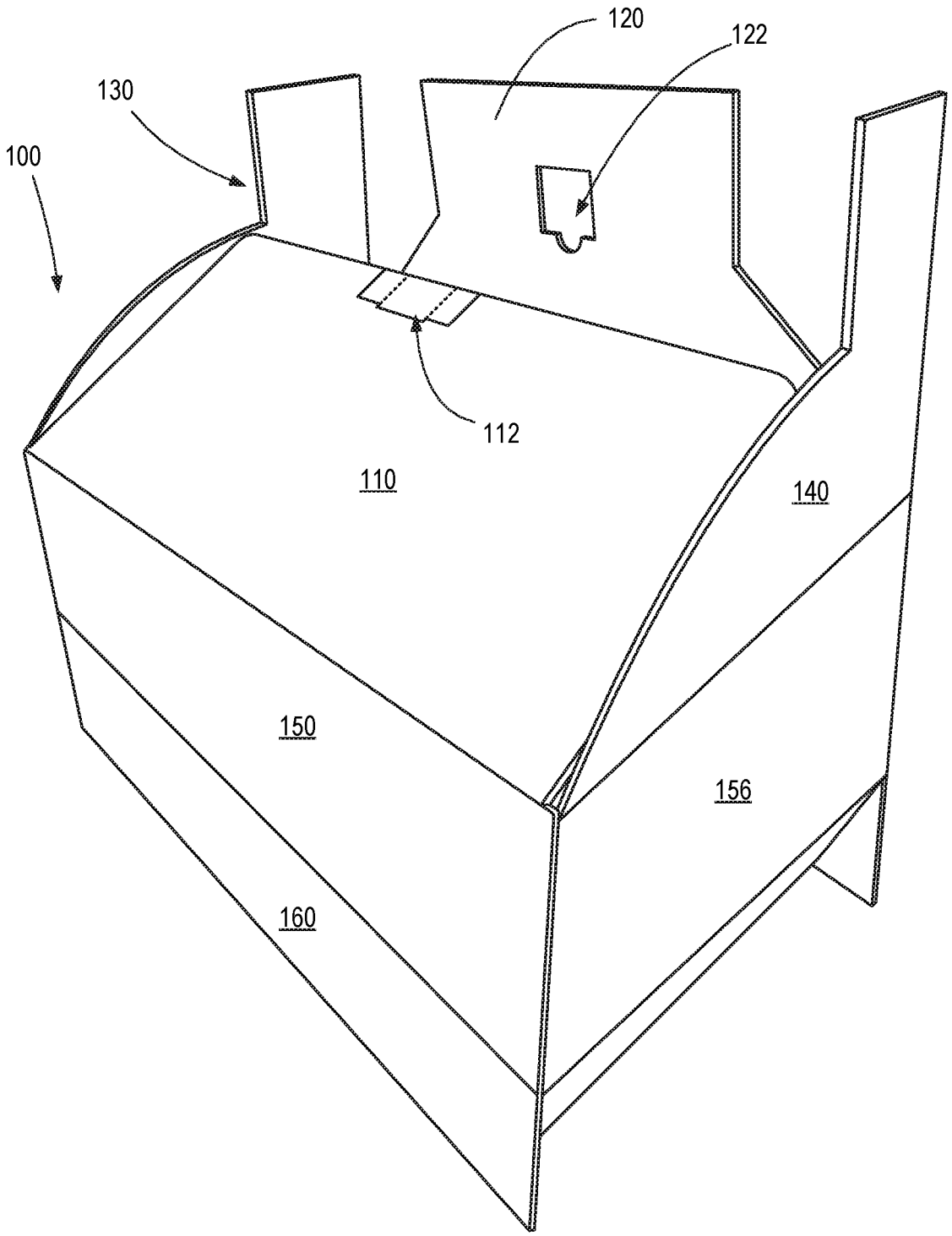
FIG. 2 is a perspective view of the sheet of FIG. 1 during an early stage of a method for folding the sheet into a container consistent with some implementations.
Figure 3:
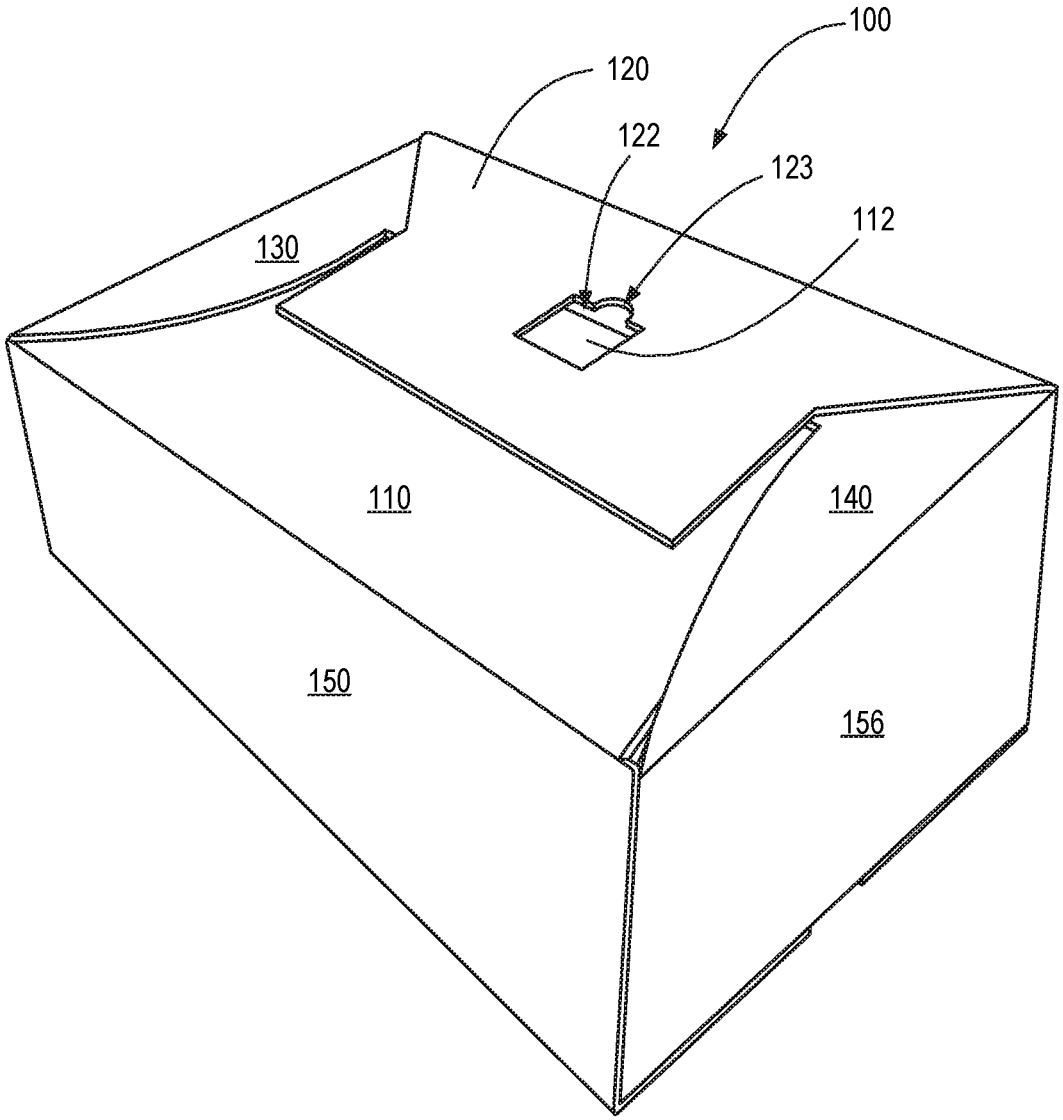
FIG. 3 is a perspective view of the sheet of FIGS. 1-2 during a subsequent stage of the folding method.
Figure 4:
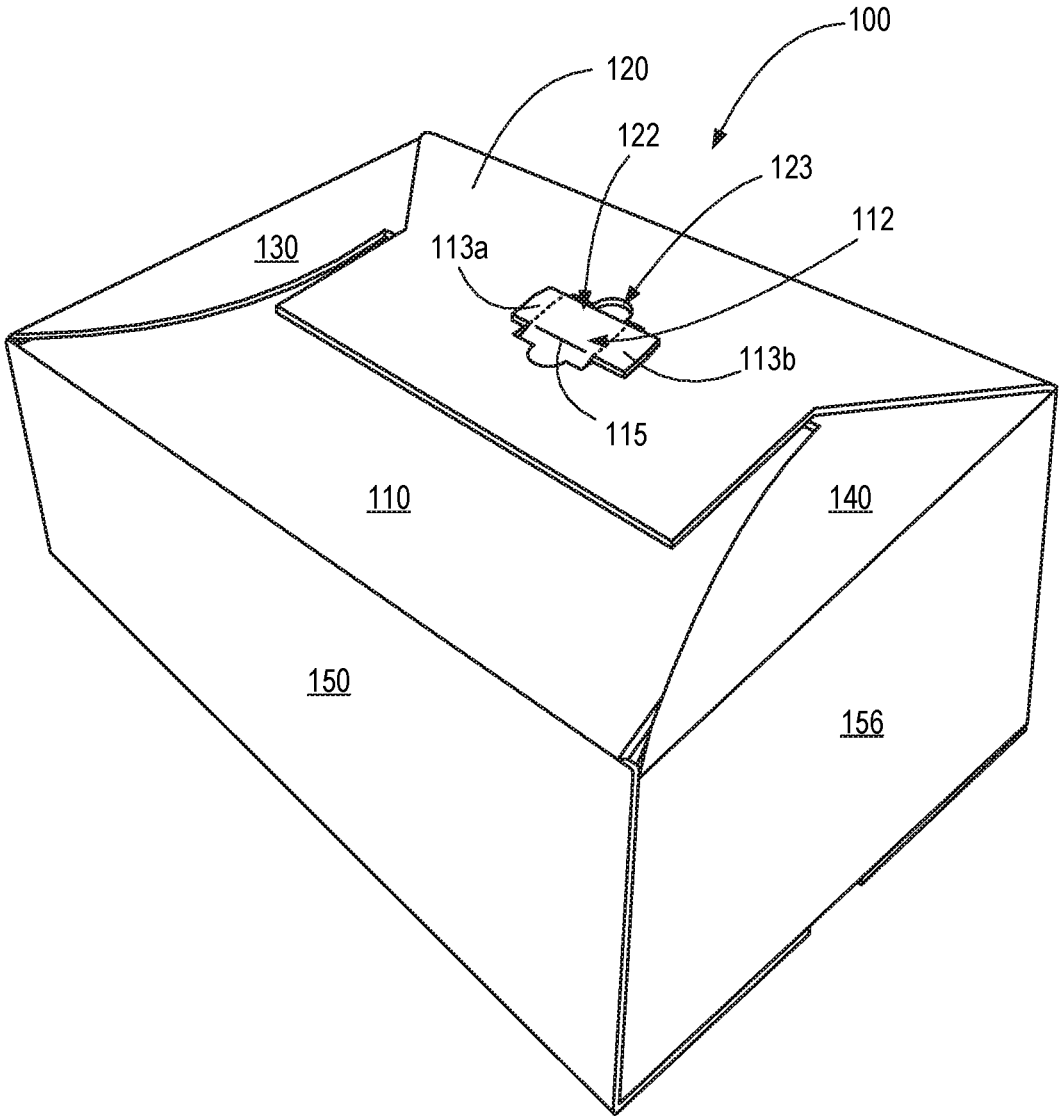
FIG. 4 is a perspective view of the sheet of FIGS. 1-3 during a final stage of the folding method after a locking tab has been inserted into a locking aperture to increase the strength of the bottom of the container.

FIGS. 2-4 depicts sheet 100 in various stages of a method for folding sheet 100 into a container. FIG. 2 depicts sheet 100 in a first step of such a method. As shown in this figure, panel 110 may be folded over relative to the other panels forming the bottom wall of the container, and ultimately such that panel 110 is at least substantially perpendicular to the panels defining sidewalls of the container, such as panels 150 and 156.

Following the folding step depicted in FIG. 2, panels 130 and 140 may be folded adjacent to panel 110. After folding panels 130 and 140, panel 120 may be folded parallel to panels 110, 130, and 140, as depicted in FIG. 3. As also shown in FIG. 3, panels 110 and 120 are aligned such that locking aperture 122 overlaps with locking tab 112. In some implementations, panel 120 may be pushed down underneath panel 110 (above from the perspective of the upright container).

Then, locking tab 112 is inserted through locking aperture 122 such that locking tab 112 engages locking aperture 122 to lock bottom panel 120 in place relative to bottom panel 110, as shown in FIG. 4. In preferred embodiments and implementations, locking tab 112 is pulled or pushed through locking aperture 122 by inserting one or more fingers into slot 123, bending locking tab 112 along fold line 115 and/or additional fold lines adjacent to flaps 113*a* and/or 113*b* to allow locking tab 112 to extend through locking aperture 122. In some implementations and embodiments, slot 123 may be configured to allow only a single finger (of a typical adult user) to be inserted therethrough.

In implementations in which panel 120 is pushed under (when the container is upside down during assembly of the bottom wall) panel 110, locking tab 112 may be pushed through locking aperture 122 from the bottom surface of the bottom wall of the container or, alternatively, may be pulled through locking aperture 122 from within the container (from the upper surface of the bottom wall of the container).

Locking tab 112 preferably has a greater size along one dimension than locking aperture 122, but a lesser size along another dimension (such as a dimension normal to the first dimension) relative to locking aperture 122, such that, after said folding/bending, it can return to its previous form and lock the various bottom panels in place.

As also shown in FIG. 4, locking tab 112 is engaged with locking aperture 122 at a location spaced apart from planes defined by each of the plurality of side panels. This location may improve the ability of the locking feature to keep the bottom wall of the container in place without failure. In the depicted embodiment, locking tab 112 is configured to be engaged with locking aperture 122 at an at least substantially central location on the bottom wall of the container relative to the plurality of side panels. However, other embodiments are contemplated in which locking tab 112 may be engaged with locking aperture 122 at a location spaced apart from planes defined by each of the plurality of side panels but not necessarily centrally positioned in this manner.

Because the "length" of locking tab 112 (extending between opposing flaps 113*a*/113*b*) is greater than the "width" of locking aperture 122 (extending in the same general direction), forces on the bottom wall of the container (typically from the inside of the container due to heavy items being placed therein) will cause flaps 113*a*/113*b* to engage panel 120, which will form a lock and assist in preventing locking tab 112 from exiting locking aperture 122, and thereby assist in preventing the bottom of the resulting container from coming undone.

In preferred assembly implementations, the method is performed without use of any adhesives, tapes, or other mechanical elements for securing the bottom wall of the container in a folded configuration. In other words, the locking tab 112/locking aperture 122, in some implementations in combination with one or more other features or elements of the panels disclosed herein, alone may be used to keep the bottom of the container together.

Figure 5:
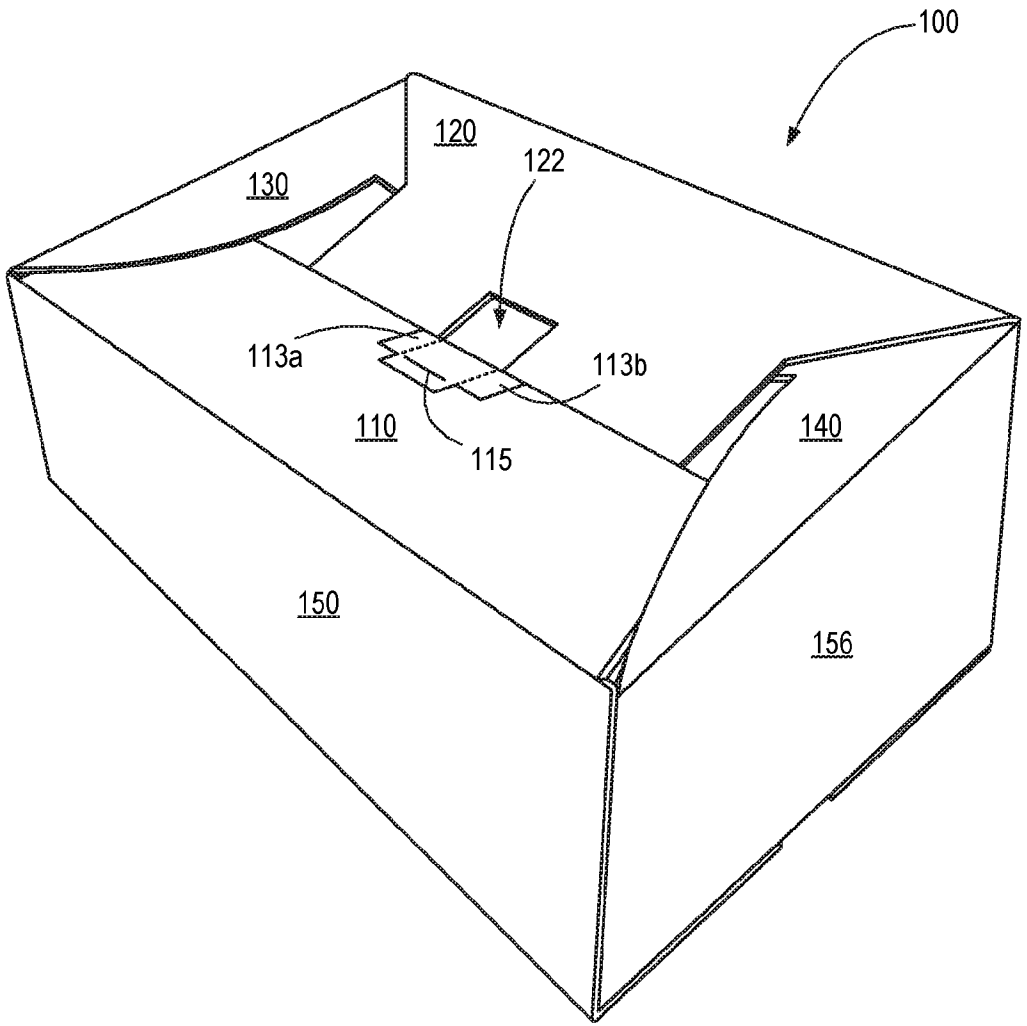
FIG. 5 is a perspective view of the sheet during an alternative folding methodology.
Figure 6:
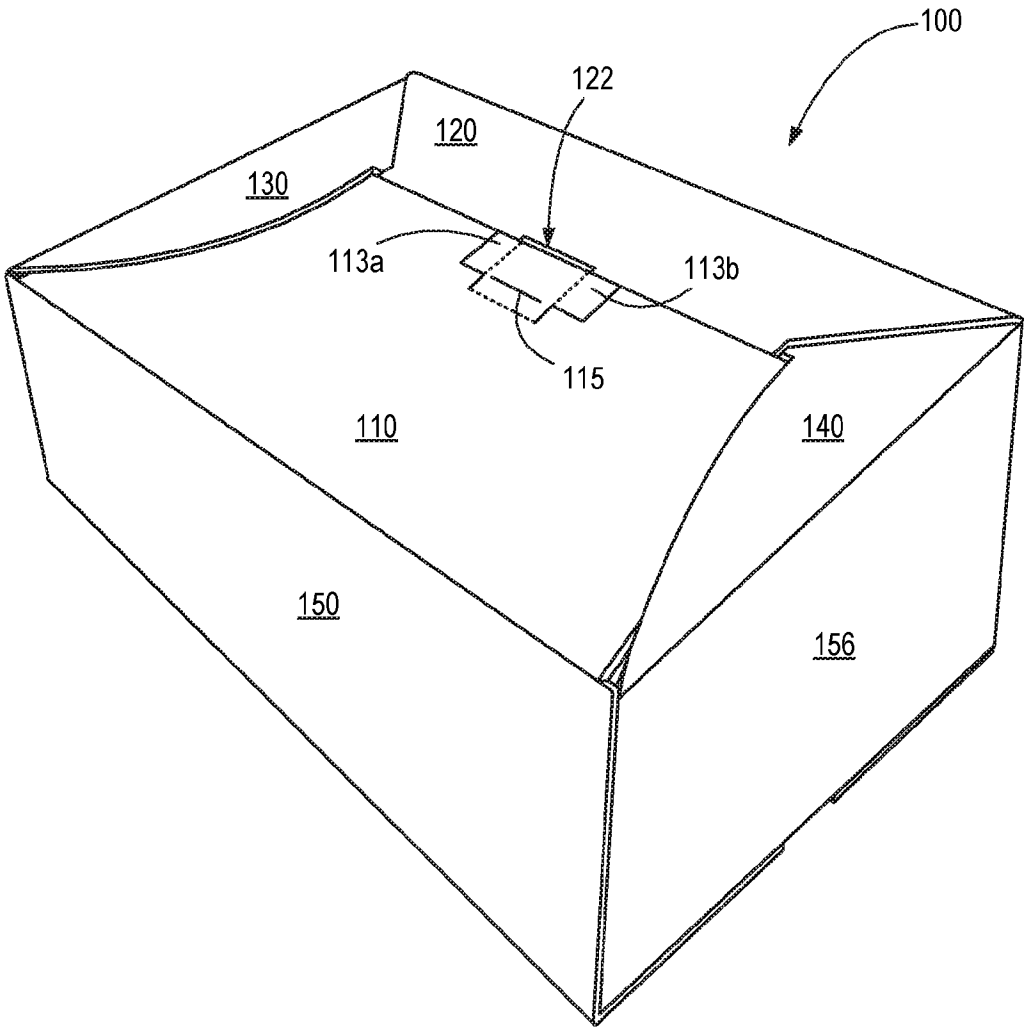
FIG. 6 is a perspective view of the sheet during a subsequent stage of the alternative folding method of FIG. 5.
Figure 7:
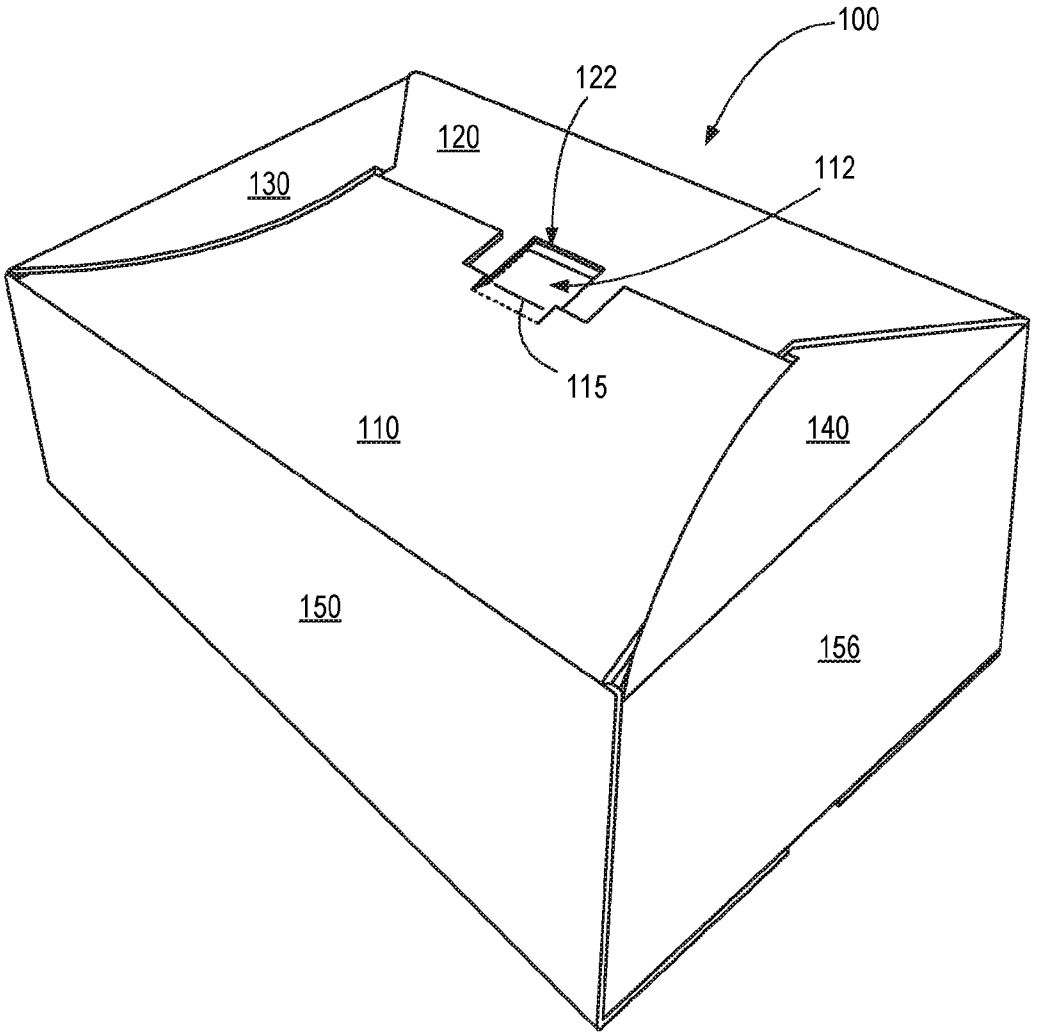
FIG. 7 is a perspective view of a finished container following the alternative folding method of FIGS. 5 and 6.

FIGS. 5-7 depict various stages of an alternative folding methodology in accordance with other implementations. The alternative folding step of FIG. 5 may follow the stage depicted in FIG. 3. In other words, as shown in FIG. 2, and as described above, panel 110 may initially be folded down such that it extends perpendicular to each of the side panels. Then, as shown in FIG. 3 and described above, panels 130 and 140 may be folded adjacent to panel 110, and panel 120 may be folded parallel to panels 110, 130, and 140. Preferably, panels 110 and 120 are aligned such that locking aperture 122 overlaps with locking tab 112.

Then, in the alternative folding method, panel 120 may be pushed down underneath panel 110 (above from the perspective of the upright container), as depicted in FIG. 5, such that locking aperture 122 is positioned below locking tab 112 (from the perspective of the upside down container shown in FIGS. 5-7, as shown in FIG. 6. Following the stage depicted in FIG. 6, the locking tab 112 may be pushed or otherwise inserted through locking aperture 122 (in some implementations, locking tab 112 may be pulled through locking aperture 122 from the inside of the container) such that locking tab 112 extends at least substantially parallel to each of the other panels, but below at least panels 110 and 120 (above from the perspective of the upright container), as shown in FIG. 7.

It will be understood by those having skill in the art that changes may be made to the details of the above-described embodiments without departing from the underlying principles presented herein. In addition, any suitable combination of various embodiments, or the features thereof, is contemplated.

Any methods disclosed herein may comprise one or more steps or actions for performing the described method. The method steps and/or actions may be interchanged with one another. In other words, unless a specific order of steps or actions is required for proper operation of the embodiment and/or implementation, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment.

Those having skill in the art will therefore appreciate that many changes may be made to the details of the above-described embodiments without departing from the underlying principles of the invention. The scope of the present invention should, therefore, be determined only by the following claims.

The invention claimed is:

1. A sheet for folding into a container, comprising:

a first bottom panel configured to define at least a portion of a bottom wall of a container, wherein the container in a finished configuration comprises a first side, a second side, a third side opposite from the first side, and a fourth side opposite from the second side, wherein the first bottom panel is configured to extend from the first side towards the third side in the finished configuration, and wherein the first bottom panel comprises a locking tab;

a second bottom panel configured to define at least a portion of the bottom wall of the container, wherein the second bottom panel is configured to extend from the second side towards the fourth side in the finished configuration;

a third bottom panel configured to define at least a portion of the bottom wall of the container, wherein the third bottom panel is configured to extend from the third side towards the first side in the finished configuration, wherein the third bottom panel comprises a locking aperture configured to receive the locking tab, wherein, in the finished configuration, the locking tab extends at least substantially parallel to the third bottom panel within the locking aperture, and wherein the locking tab and the locking aperture are configured to increase an amount of force on the bottom wall required to unfold panels defining the bottom wall;

wherein the locking aperture comprises a length extending between the first side and the third side in the finished configuration, wherein the locking aperture comprises a width extending between the second side and the fourth side in the finished configuration, wherein the locking tab comprises a width extending between the second side and the fourth side in the finished configuration, wherein the locking tab comprises a length extending between the first side and the third side in the finished configuration, wherein the length of the locking tab is less than the length of the locking aperture, and wherein the width of the locking tab is greater than the width of the locking aperture; and a fourth bottom panel configured to define at least a portion of the bottom wall of the container, wherein the fourth bottom panel is configured to extend from the fourth side towards the second side in the finished configuration.

2. The sheet of claim 1, wherein the third bottom panel comprises:

a first edge foldably coupled to a side panel at the third side; and a second edge opposite from the first edge, wherein the locking aperture is spaced apart from the first edge, and wherein the locking aperture is spaced apart from the second edge.

3. The sheet of claim 2, wherein the locking tab is configured to be engaged with the locking aperture at an at least substantially central location on the bottom wall relative to first side, second side, third side, and fourth side of the container.

4. The sheet of claim 1, wherein the locking aperture comprises a slot positioned and configured to allow a user to insert a finger therethrough when the third bottom panel is positioned parallel to the fourth bottom panel with the locking tab positioned adjacent to the locking aperture.

5. The sheet of claim 4, wherein the slot is configured to allow only a single finger to be inserted therethrough when the third bottom panel is positioned parallel to the fourth bottom panel with the locking tab positioned adjacent to the locking aperture.

6. The sheet of claim 1, wherein the locking tab comprises at least one flap configured to be bent during assembly of the sheet into a container to allow the locking tab to extend through the locking aperture.

7. The sheet of claim 6, wherein the locking tab comprises opposing flaps configured to be bent during assembly of the sheet into a container to allow the locking tab to extend through the locking aperture.

8. The sheet of claim 7, wherein the locking tab width extends from a first edge of a first flap of the opposing flaps to a second edge of a second flap of the opposing flaps.

9. A container, comprising:

a bottom wall defined by at least a first bottom panel and a second bottom panel, wherein the first bottom panel comprises:

a first edge foldably coupled to a first side panel;

a second edge opposite from the first edge; and a locking tab positioned adjacent to the second edge, and wherein the second bottom panel comprises:

a first edge foldably coupled to a second side panel;

a second edge opposite from the first edge; and a locking aperture configured to receive the locking tab from the first bottom panel, wherein the locking aperture is spaced apart from the first edge of the second bottom panel, wherein the locking aperture is spaced apart from the second edge of the second bottom panel, wherein the locking aperture further comprises a slot extending from one side of the locking aperture, and wherein the slot is configured to receive a user's finger during assembly of the container to allow the locking tab to be pulled or pushed through the locking aperture with a single finger.

10. The container of claim 9, further comprising:

a third bottom panel; and a fourth bottom panel, wherein the bottom wall is further defined by the third bottom panel and the fourth bottom panel.

11. The container of claim 9, wherein the locking aperture comprises an at least substantially rectangular shape.

12. The container of claim 11, wherein the slot protrudes from one side of the at least substantially rectangular shape of the locking aperture.

13. The container of claim 9, wherein the locking tab comprises at least one flap that extends beyond a width of the locking aperture when the locking tab is positioned adjacent to the locking aperture.

14. The container of claim 13, wherein the locking tab comprises two opposing flaps, each of which extends beyond a width of the locking aperture at opposite ends of the locking aperture when the locking tab is positioned adjacent to the locking aperture.

15. The container of claim 9, wherein the locking tab and the locking aperture are configured to increase an amount of force on the bottom wall required to uncouple the first bottom panel from the second bottom panel.

16. A method for folding a sheet into a container, comprising:

folding each of a plurality of side panels to create an open container structure;

folding a first bottom panel relative to an adjacent first side panel to define at least a portion of a bottom wall of the container, wherein the first bottom panel comprises a locking tab;

folding a second bottom panel relative to an adjacent second side panel to overlap with the first bottom panel and define at least a portion of the bottom wall of the container, wherein the second bottom panel comprises a locking aperture; and inserting the locking tab into the locking aperture such that the locking tab engages the locking aperture to lock the first bottom panel in place relative to the second bottom panel, wherein the locking tab is engaged with the locking aperture at a location spaced apart from planes defined by each of the plurality of side panels, wherein the step of inserting the locking tab into the locking aperture comprises:

positioning the locking tab adjacent to the locking aperture;

inserting a finger into a slot positioned at one end of the locking aperture; and pulling the locking tab through the locking aperture.

17. The method of claim 16, wherein the method is performed without use of any adhesives, tapes, or other mechanical elements for securing the bottom wall of the container in a folded configuration.

18. The method of claim 16, wherein the locking tab is configured to be engaged with the locking aperture at an at least substantially central location on the bottom wall of the container relative to the plurality of side panels.

19. The method of claim 16, wherein the step of pulling the locking tab through the locking aperture comprises bending two opposing flaps formed on opposite ends of the locking tab to allow the locking tab to fit through the locking aperture.

20. The method of claim 16, further comprising, after the step of folding the second bottom panel relative to an adjacent side panel to overlap with the first bottom panel and define at least a portion of the bottom wall of the container, repositioning the second bottom panel relative to the first bottom panel such that the locking tab is repositioned from adjacent to first side of the locking aperture to adjacent to a second side of the locking aperture opposite from the first side.

* * * * *